United States Patent [19]

Peart

[11] 4,109,220

[45] Aug. 22, 1978

[54] CATHODE RAY TUBE ASSEMBLIES

[75] Inventor: Norman Eli Peart, Grotton, near Oldham, England

[73] Assignee: Limited Ferranti, Hollinwood, England

[21] Appl. No.: 734,878

[22] Filed: Oct. 22, 1976

[30] Foreign Application Priority Data

Oct. 24, 1975 [GB] United Kingdom ..... 43836/75

[51] Int. Cl.[2] ..... H01F 7/00

[52] U.S. Cl. ..... 335/212; 335/211

[58] Field of Search ..... 335/212, 211

[56] References Cited

U.S. PATENT DOCUMENTS

| | | | |
|---|---|---|---|
| 3,247,426 | 4/1966 | Havn | 335/212 |
| 3,376,450 | 4/1968 | Franklin | 335/212 |
| 3,496,501 | 2/1970 | Harten et al. | 335/212 |

*Primary Examiner*—Harold Broome

*Attorney, Agent, or Firm*—Cameron, Kerkam, Sutton, Stowell & Stowell

[57] ABSTRACT

A cathode ray tube assembly including a plurality of permanent magnets to correct for pin cushion and barrel distortion has each adjustable magnet comprising at least part of a rotatable member, facilitating the provision of means to clamp the magnet in its required position, and facilitating the provision of a rugged assembly which is suitable, for example, for use in an aircraft.

4 Claims, 2 Drawing Figures

CATHODE RAY TUBE ASSEMBLIES

Figure 1:
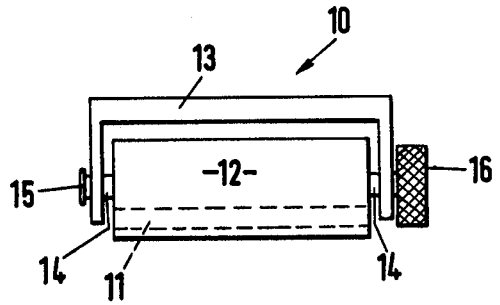

This invention relates to cathode ray tube assemblies, and in particular to the correction of pin cushion and barrel distortion of displays to be provided on the screens of cathode ray tubes.

Pin cushion and barrel distortion of displays to be provided on the screen of a cathode ray tube, and caused by magnetic deflections, usually are corrected at least partially whilst the performance of the cathode ray tube is being adjusted prior to mounting it in its operable position. For this purpose the cathode ray tube assembly may include a plurality of permanent magnets mounted at predetermined positions in relation to the envelope of the cathode ray tube. At least one of the magnets is adjustably mounted at an associated predetermined position in relation to the envelope of the cathode ray tube, and is displaced by an operator so as to assist in at least partially correcting for pin cushion and barrel distortion. A known way of adjustably mounting a magnet is to provide a deformable support for the magnet, the deformable support being secured to the associated predetermined position on a frame within the cathode ray tube assembly, such as the deflection coil yoke, or being secured directly on the envelope of the cathode ray tube. However, such an arrangement is unsuitable if the cathode ray tube assembly is to have a rugged construction, for example, so that the cathode ray tube assembly is suitable to be employed in an aircraft.

It is an object of the present invention to provide a cathode ray tube assembly including at least one permanent magnet adjustably mounted at a predetermined position in relation to the envelope of the cathode ray tube, the arrangement being such that the magnet is displaceable to assist in correcting at least partially for pin cushion and barrel distortion of displays to be provided on the screen of the cathode ray tube, and then the magnet easily may be clamped, and the cathode ray tube assembly has a rugged construction.

According to the present invention a cathode ray tube assembly includes a plurality of permanent magnets, so that pin cushion and barrel distortion of displays on the screen of the cathode ray tube can be at least partially corrected, at least one magnet comprising at least part of a member rotatably mounted on a support secured to an associated predetermined position in relation to the envelope of the cathode ray tube, the arrangement being such that the intensity of the field of the magnet upon the electron beam produced within the cathode ray tube is variable by rotating the member, and means is provided to clamp each member in its required rotational position on its associated support.

Any number of magnets may be provided, but it is usual for the magnets to be arranged in pairs at diametrically opposite points in relation to the centre of the displays to be provided on the screen of the cathode ray tube, to provide correction for pin cushion or barrel distortion. Further, for rectangular-shaped displays, for example, for displays produced by a raster action, the magnets are positioned adjacent to the mid-points of the edges of the displays and/or adjacent to the corners of the displays. More than one magnet, and possibly all the magnets, may be adjustably mounted in the manner referred to above to assist in correcting at least partially for pin cushion and barrel distortion of the displays.

Each magnet adjustably mounted in the manner referred to above may have any convenient shape, for example, having a cylindrical shape with a pole piece adjacent to each end.

If each magnet adjustably mounted in the manner referred to above comprises the rotatable member the pole pieces of the magnet are arranged assymmetrically in relation to the rotational axis of the member.

If each magnet adjustably mounted in the manner referred to above comprises part of the rotatable member the magnet is secured for rotation with holding means comprising the other part of rotatable member. The pole pieces of the magnet may be arranged assymmetrically in relation to the rotational axis of the member, or the axis extending between the pole pieces of the magnet may be parallel to, but spaced from, the rotational axis of the member. The holding means may have any convenient form, for example, comprising a split ring of resilient material, the associated adjustable magnet being secured by the holding means resiliently tightening onto the surface of the magnet. The arrangement may be such that each adjustable magnet is held by the associated holding means so as to be easily detached from the holding means and to be readily replaced by one of a different pole strength, if desired. In addition, or alternatively, the arrangement may be such that each adjustable magnet is secured by the associated holding means so as to be displacable in relation to the holding means, additionally, to vary the intensity of the field of the magnet upon the electron beam produced within the cathode ray tube.

Each support for a rotatable member may be generally U-shaped with the member rotatably mounted between the arms thereof, the support may be of ferromagnetic material so as to comprise a shunt for the magnet, and the arrangement is such that at least one air gap with an adjustable width is provided within the magnetic circuit including the shunt, additionally, to vary the intensity of the field of the adjustable magnet upon the electron beam produced within the cathode ray tube. Otherwise each support may have any convenient form.

The supports may be secured to predetermined positions on a frame provided within the cathode ray tube assembly. The frame may comprise part of the deflection coil yoke of the cathode ray tube assembly; or it may comprise a collar secured adjacent to the periphery of the screen of the cathode ray tube; or it may comprise a member secured adjacent to the front face of the screen of the cathode ray tube.

Suitable clamping means for each rotatable member is provided easily, and may have any convenient form. Thus, the clamping means may comprise a knob in screw-threaded engagement with an axle for the member and arranged to be tightened against the support for the member. Alternatively, the clamping means may comprise a set screw in a co-operating screw-threaded bore in a bush of the associated support, an axle of the member being rotatably mounted in the bush. The clamping means may have a resilient action, for example, comprising a lug on the support and resiliently engaging the associated rotatable member; or the clamping means may be arranged to tighten onto the member through a spring washer.

Figure 2:
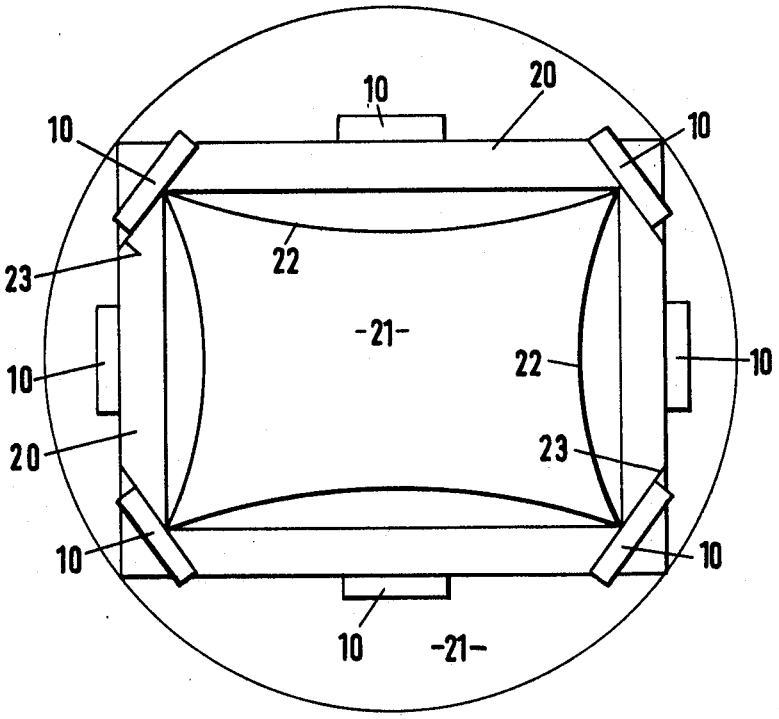

The present invention will now be described by way of example with reference to the accompanying drawings, in which, FIG. 1 is a front elevation view of a structure for a cathode ray tube assembly and comprising a member including a permanent magnet, the member being rotatably mounted on an associated support, the intensity of the field of the magnet beyond the support, and upon the electron beam produced within the cathode ray tube, being variable by rotating the member, and FIG. 2 is a front elevation view of a frame secured adjacent to the front face of the screen of a cathode ray tube, and having a plurality of the structures of FIG. 1 arranged to assist in correcting at least partially pin cushion and barrel distortion of displays to be provided on the screen of the cathode ray tube.

As shown in FIG. 1 a structure 10 for a cathode ray tube assembly comprises a member including a cylindrical permanent magnet 11 having poles adjacent to each end, and the magnet 11 being held within the member, which member is rotatably mounted on a support 13. The member also includes holding means 12 in the form of a split ring of non-magnetic, resilient material, and is tightened onto the surface of the magnet 11 to hold it. The holding means 12 is provided with an integral axle 14 which at its ends is a close fit in bores in the support 13. The axle 14 is held by one end 15 being swaged, and a knob 16 is in screw-threaded engagement with the other end. The support 13 is generally U-shaped with the member rotatably mounted between the arms thereof. The longitudinal axis of the magnet 11 is parallel to, but spaced from, the axle 14.

The support 13 is of ferro-magnetic material, and comprises a shunt for the magnet. By rotation of the member the intensity of the field strength due to the magnet beyond the support 13 is variable. The member, and hence the magnet 11, easily may be clamped in a desired rotational position by tightening the knob 16 on the axle 14 against the adjacent arm of the support 13.

A plurality of structures 10 shown in FIG. 1 are included within a cathode ray tube assembly to correct at least partially pin cushion and barrel distortion in displays to be provided on the screen of a cathode ray tube of a conventional construction, such distortion being caused by inadvertent magnetic deflections.

As shown in FIG. 2, a rectangular-shaped hollow frame 20 is secured adjacent to the front face 21 of the screen of the cathode ray tube. The aperture in the frame 20 substantially conforms to the shape of the displays to be provided by a raster action. However, due to inadvertent magnetic deflections the displays may have either pin cushion distortion or barrel distortion, the boundary of a display with pin cushion distortion being indicated at 22. In order to correct at least partially either such form of distortion within the frame 20 eight of the structures 10, shown in FIG. 1, are mounted at predetermined positions on the frame 20, each such structure being indicated only generally in FIG. 2. Four of the structures are mounted adjacent to the mid-points of the edges of the displays to be provided, with the longitudinal axes of the magnets parallel to the desired positions of these edges. The other four structures are mounted adjacent to the corners of the displays to be provided, these structures being mounted on brackets 23 so that the longitudinal axes of the magnets are substantially tangential to a circle concentric with the centre of the displays.

An operator rotates manually the members holding the magnets 11 to assist in correcting for distortion, and whilst the cathode ray tube is being adjusted prior to mounting it in its operable position. By being held within the rotatable members the magnets 11 are adjustably mounted at the predetermined positions on the frame, and are readily displaceable by the operator to their appropriate positions. As the members are rotated the intensities of the fields of the magnets 11 upon the electron beam produced within the cathode ray tube are varied.

When the magnets 11 are in their appropriate positions the rotatable members easily are clamped by the operator tightening the knobs 16 against the adjacent arms of the supports 13.

In one particular embodiment according to the present invention the rectangular-shaped displays to be provided on the screen are each 4 inches by 6 inches. Each magnet is 1.25 inch long.

The means according to the present invention is both easy to adjust so that pin cushion and barrel distortion is corrected at least partially at different portions of the screen of the cathode ray tube, and the magnets are easily clamped in their appropriate positions. Thus, a cathode ray tube assembly with a rugged construction is obtained, and is suitable to be employed, for example, in an aircraft.

The arrangement of each structure 10 is such that the magnet 11 readily may be replaced within the rotatable member by a magnet of different pole strength, if desired. The arrangement is also such that the magnet may be displaced longitudinally within the member, additionally, to vary the intensity of the field of the magnet upon the electron beam produced with the cathode ray tube.

The magnets may not be cylindrical in shape, and may not be identical in shape.

Whilst at least one magnet is required to be rotatably mounted in a cathode ray tube assembly according to the present invention, it is not essential that all the magnets provided within the assembly are so mounted. Any number of magnets more than one may be provided, but usually opposing pairs of magnets are provided at diametrically opposite points in relation to the centre of the displays to be provided on the screen of the cathode ray tube, to provide symmetrical correction for pin cushion distortion or barrel distortion. It may be required to provide only two, four or six magnets appropriately positioned, to correct for the distortion.

It is not essential that all the structures 10 extend in a common plane.

Each member including a magnet 11, and rotatably mounted, may have any convenient form, and may hold the magnet in any convenient way. The non-magnetic material of the member may comprise, or include, aluminium, brass, or any suitable resin or plastics material.

Alternatively, a magnet may comprise a rotatable member, and may have any convenient shape, if the pole pieces of the magnet are assymmetrically arranged in relation to the rotational axis of the member.

Each member may be rotatably mounted on a support of any convenient form. In the illustrated arrangement an air gap is provided between each pole of the magnet and the adjacent arm of the support, and the width of at least one of the air gaps is adjustable, for example, by bending at least one arm of the support additionally, to vary the intensity of the field of the magnet upon the electron beam produced within the cathode ray tube. It is not essential that such air gaps are provided. The support material may be ferro-magnetic by comprising soft iron. However, it is not essential that the support material is ferro-magnetic, and so will not comprise a magnetic shunt.

The frame 20 may be of ferro-magnetic material or of non-magnetic material. The frame may be at any suitable position within the cathode ray tube assembly. For example, the frame may be secured adjacent to the periphery of the screen of the cathode ray tube, or it may comprise part of the deflection coil yoke of the cathode ray tube assembly. It is not essential that the structures 10 are secured to a frame, and instead they may be secured to any conveniently provided predetermined positions within the cathode ray tube assembly. The deflection coil yoke is precisely located in relation to the path of the electron beam before it impinges on the mid-point of the screen, and hence is suitable for a frame for the structures according to the present invention. Hence, it is advantageous to mount the magnets on the deflection coil yoke. However, it is not essential in order to correct for pin cushion and barrel distortion for the magnets to be precisely located in relation to this electron beam path. Further, it is not essential that each magnet of an opposing pair should be equally spaced from this electron beam path.

The clamping means for the rotatable member may have any convenient form. Instead of the illustrated arrangement the clamping means may comprise a set screw in a co-operating screw-thread bore in a bush of the associated support, an axle of the member being rotatably mounted in the bush.

The clamping means may have a resilient action, for example, comprising a lug on each support and resiliently engaging the associated rotatable member, or the clamping means may be arranged to tighten onto the member through a spring washer.

The displays to be provided on the screen may not be formed by a raster of parallel lines in a manner conventional for a television receiving set, and may not be rectangular in shape. Thus, stroke written or random access displays, generated by a computer, may be provided, and the structures including the magnets are positioned at convenient predetermined positions within the cathode ray tube.

The cathode ray tube may have any construction, for example, having the electron beam deflected through substantially 90° before impinging on the screen.

Usually the cathode ray tube assembly will also include means to correct for astigmatic errors.

What I claim is:

1. A cathode ray tube assembly including a cathode ray tube having an envelope and a screen, a plurality of permanent magnets each having a pair of pole pieces for at least partially correcting pin cushion and barrel distortion of displays on the screen of the cathode ray tube, a support for each magnet secured to an associated predetermined position in relation to the envelope of the cathode ray tube, at least one magnet being adjustably mounted, to vary the intensity of the field of the magnet upon the electron beam produced within the cathode ray tube, by comprising at least part of a member rotatably mounted on the associated support, and means to clamp the member in its required rotational position on its associated support, each support for a rotatable member being generally U-shaped with a member rotatably mounted between the arms thereof, is of ferro-magnetic material so as to comprise a shunt for the magnet, and is so arranged that at least one air gap of an adjustable width is provided within the magnetic circuit including the shunt to additionally vary the intensity of the field of the adjustable magnet upon the electron beam produced within the cathode ray tube.

2. The cathode ray tube assembly as claimed in claim 1 including means comprising another part of the rotatable member for holding each adjustable magnet for rotation with said rotatable member.

3. A cathode ray tube assembly as claimed in claim 2 in which the axis extending between the pole pieces of each adjustable magnet is parallel to, but spaced from, the rotational axis of the member.

4. A cathode ray tube assembly as claimed in claim 2 in which each adjustable magnet is displaceable in relation to the associated holding means, to additionally vary the intensity of the field of the magnet upon the electron beam produced within the cathode ray tube.

* * * * *